United States Patent [19]

Lehman et al.

[11] 4,115,247

[45] Sep. 19, 1978

[54] BENZENE PRODUCTION BY SOLVENT EXTRACTION AND HYDRODEALKYLATION

[75] Inventors: Leon M. Lehman, Miami Beach; Glen I. Lambert, Miami, both of Fla.

[73] Assignee: Hydrocarbon Research, Inc., Lawrenceville, N.J.

[21] Appl. No.: 706,026

[22] Filed: Jul. 16, 1976

[51] Int. Cl.[2] ..... C10G 35/18; C07C 3/58

[52] U.S. Cl. ..... 208/62; 208/96; 260/672 R; 260/674 SE

[58] Field of Search ..... 260/672 R, 674 SE; 208/62, 96

[56] References Cited

U.S. PATENT DOCUMENTS

| | | | |
|---|---|---|---|
| 3,371,126 | 2/1968 | Carson | 260/672 R |
| 3,398,083 | 8/1968 | Addison | 260/674 SE |
| 3,435,084 | 3/1969 | Cabbage et al. | 260/672 R |
| 3,436,434 | 4/1969 | Lester | 260/672 R |
| 3,558,480 | 1/1971 | Broughton | 260/674 SE |

*Primary Examiner*—C. Davis

*Attorney, Agent, or Firm*—Michael A. Jacobs

[57] ABSTRACT

A process for converting a naphtha feedstock to a pure benzene including the steps of: reforming the naphtha; removing a major fraction of $C_4$ - $C_5$ and heavy reformate components to obtain a reformate containing a major portion of $C_6$ - $C_8$ aromatic hydrocarbons and an associated saturated portion; extracting the aromatic hydrocarbons from the reformate countercurrently in a simplified process with a selective hydrophilic solvent, such as sulfolane, having high solubility for aromatic hydrocarbons and low solubility for paraffinic hydrocarbons to obtain an extract stream rich in $C_6$ - $C_8$ aromatic hydrocarbons and a raffinate stream rich in paraffinic hydrocarbons; and recovering the selective solvent from the extract stream to obtain an aromatic component comprising a major $C_6$ - $C_8$ aromatic hydrocarbons and about 3 to 18 wt. % paraffinic hydrocarbon impurity. The paraffinic impurity is removed and alkyl benzenes are converted by hydrodealkylating the aromatic component to recover substantially pure benzene.

A feature of the simplified extraction process provides for low energy consumption because no stream rich in paraffin is recycled to the solvents extraction unit, thus eliminating the need for stripping the paraffinic impurity from the aromatic component prior to dealkylation.

11 Claims, 2 Drawing Figures

BENZENE PRODUCTION BY SOLVENT EXTRACTION AND HYDRODEALKYLATION

BACKGROUND OF THE INVENTION

This invention relates to a new and improved process for recovering the aromatic components from aromatic containing feedstocks and is particularly adapted to hydrocarbon mixtures containing large concentrations of aromatics. More specifically, this invention is directed to an improved extraction process for the recovery of aromatics whereby selective solvents are employed. The extraction step is a simple countercurrent system, with an impure extract being recovered from the solvent and used as feedstock for a hydrodealkylation process.

Ordinarily when a solvent selective for aromatics is used for the purpose of isolating aromatics at high recovery (about 99%) and high purity (about 99%) the feed is first extracted with the solvent and then some device such as a countersolvent, temperature induced back wash, flashed back wash, or extractively stripped back wash is used to improve the aromatic purity obtained by the simple extraction step. The liquid feed may be contacted with a sulfolane solvent in an absorber-stripper column wherein the aromatics are removed as bottoms at high purity, but only at moderately high recovery (about 80 to 90%).

The combined use of solvent extraction and hydrodealkylation steps for aromatics production is a known combination; however, the prior processes involved intermediate purification steps to produce pure aromatics feed to the hydrodealkylation step. In U.S. Pat. No. 3,159,567, a solvent-extracted gas oil is purified to produce methyl naphthalene for hydrodealkylation. In U.S. Pat. No. 3,726,789, the aromatic components of a reformate stream are extracted and separated into high purity toluene for hydrodealkylation and also high purity benzene, xylene, etc. is recovered from the extract. The combination of solvent extraction and dealkylation is also shown in U.S. Pat. No. 3,213,152.

Prior workers have extended great efforts in producing a pure paraffin-free aromatic extract stream. It has been recognized that selective solvents which are used in extracting aromatic components from paraffins are not totally selective in rejecting the paraffinic hydrocarbons. This has led to prevalent use of a back wash step wherein a light paraffin stream is contacted with the solvent extract phase to minimize absorption of heavier paraffins, which are difficult to separate from the aromatic product downstream. Representative backwashing techniques are described in U.S. Pat. No. 2,877,173, 2,921,015, 2,938,858, 3,146,190, 3,222,416 and 3,435,087. All of these processes have the disadvantage of requiring light paraffin stripping to obtain adequate product purity. The recovered aromatic stream from such prior process is very pure, usually with no detectable paraffin (i.e., less than 0.01%), however, the energy requirements are high, due to the additional separation of recycled paraffins.

While it is known to employ simple countercurrent extraction of a reformate paraffinic-aromatic mixture without light paraffin back wash, the amount of impurity in the extract would be prohibitive for many end uses of the product. If the product specifications are not demanding, as in the case of gasolines blended with extracted aromatics in U.S. Pat. No. 2 956 006, a simple continuous extraction column without raffinate refluxing, back wash or other recycle expedient is feasible.

SUMMARY OF THE INVENTION

A continuous process has been found for converting a naphtha feedstock to benzene. The process may be utilized as an integrated system for catalytically reforming the naphtha. By-product gas, $C_4$ - $C_5$ components, and heavy reformate are removed to obtain a $C_6$ - $C_8$ reformate rich in aromatic hydrocarbons. The reformate is then contacted with a solvent in a simplified system to extract aromatic hydrocarbons from the $C_6$ - $C_8$ reformate. The selective solvent has high solubility for aromatic hydrocarbons and low solubility for aliphatic hydrocarbons, permitting formation of an extract phase rich in $C_6$ - $C_8$ aromatic hydrocarbons and a raffinate phase rich in aliphatic hydrocarbons. After separating the extract phase from the raffinate phase, the selective solvent is recovered from the extract phase to obtain an aromatic stream containing about 3 to 18 weight percent aliphatic hydrocarbon impurity. After combining and hydrodealkylating the impure aromatic stream and the heavy reformate, substantially pure benzene is recovered, along with hydrodealkylation off-gas. Hydrodealkylation off-gas maybe combined with at least a portion of the by-product gas from reforming and fed to a purification unit to recover a fuel gas and purified hydrogen. The hydrogen is recovered in purity suitable for recycle to the hydrodealkylation step.

The simplified extraction step avoids the separate recovery of paraffins from the extract phase, thus reducing the energy requirements as compared to backwash extraction systems.

THE DRAWING

FIG. 1 is a schematic flow diagram showing the relation between the solvent extraction step and other refinery steps, and FIG. 2 shows the main components of the simplified extraction system in schematic form.

DESCRIPTION OF PREFERRED EMBODIMENTS

In the following description parts by weight, metric units and pressure in absolute atmospheres are used unless otherwise indicated. The continuous system may be operated on a semi-continuous or semi-batch basis; but, steady state operation is preferred.

Figure 1:
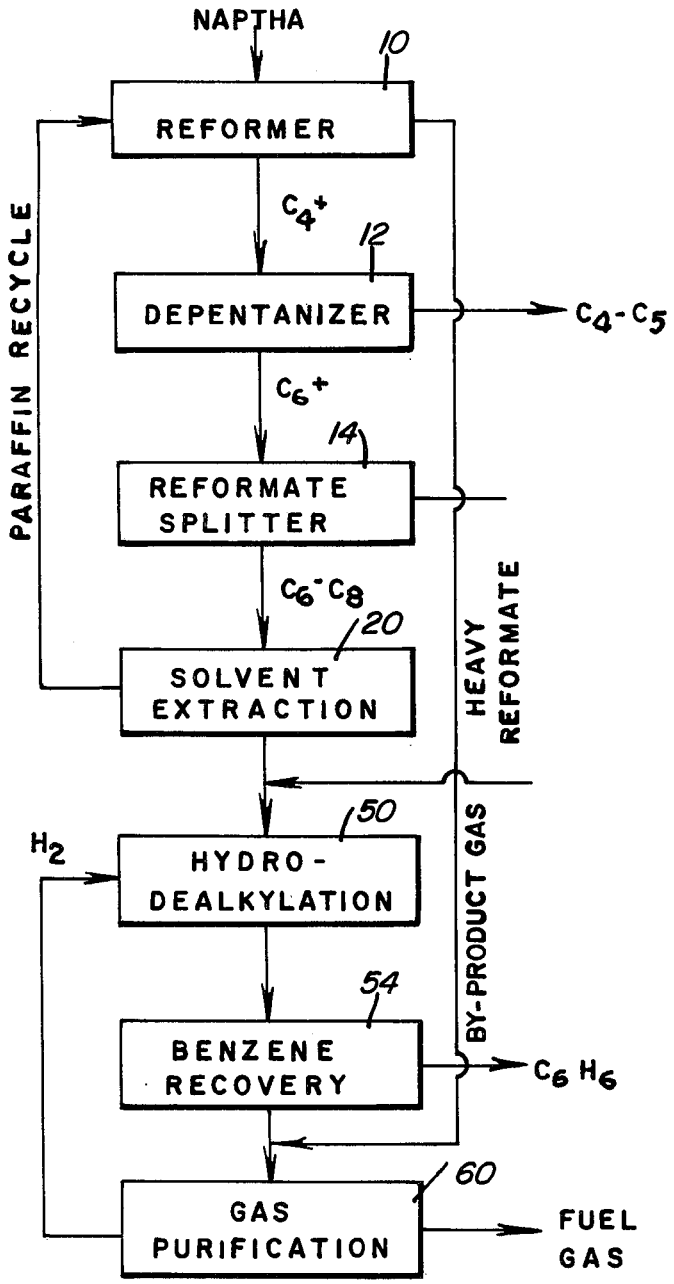

Referring now to FIG. 1, a naphtha feedstock is passed to a reformer unit 10 wherein a substantial portion of the paraffin, and cyclic naphthene components are converted catalytically to aromatics. Leaving reformer unit 10 is a stream of $C_{4+}$ hydrocarbons and a by-product gas stream containing hydrogen and lower paraffins ($C_1$ - $C_3$). The $C_4$ - $C_5$ components are removed from the reformate stream in depentanizer unit 12 and the recovered $C_4$ - $C_5$ hydrocarbons may be used for plant fuel. The depentanized $C_{6+}$ stream is then passed to reformate splitter 14, which separates a heavy reformate fraction for use as hydrodealkylation feedstock. A mixed $C_6$ - $C_8$ paraffinic-aromatic hydrocarbon stream is fed to solvent extraction unit 20. The paraffinic raffinate from solvent extraction may be recycled to reformer 10 in order to optimize aromatics production of the system.

The aromatic-rich extract is combined with heavy reformate and passed to hydrodealkylation unit 50 where it is heated in the presence of excess $H_2$ to produce benzene and lower paraffin gas. Benzene product is separated in the benzene recovery unit 54 which generally includes fractionation equipment familiar to those versed in the art. The hydrodealkylation off-gas may be combined with at least a portion of by-product gas from reformer 10 and purified in gas purification unit 60, which is preferably a cryogenic gas separation plant capable of producing at least 90% pure hydrogen for recycle to the hydrodealkylation unit. Fuel gas is also recovered from purification unit 50. Make up hydrogen may be added to recycle hydrogen prior to the hydrodealkylation step.

Figure 2:
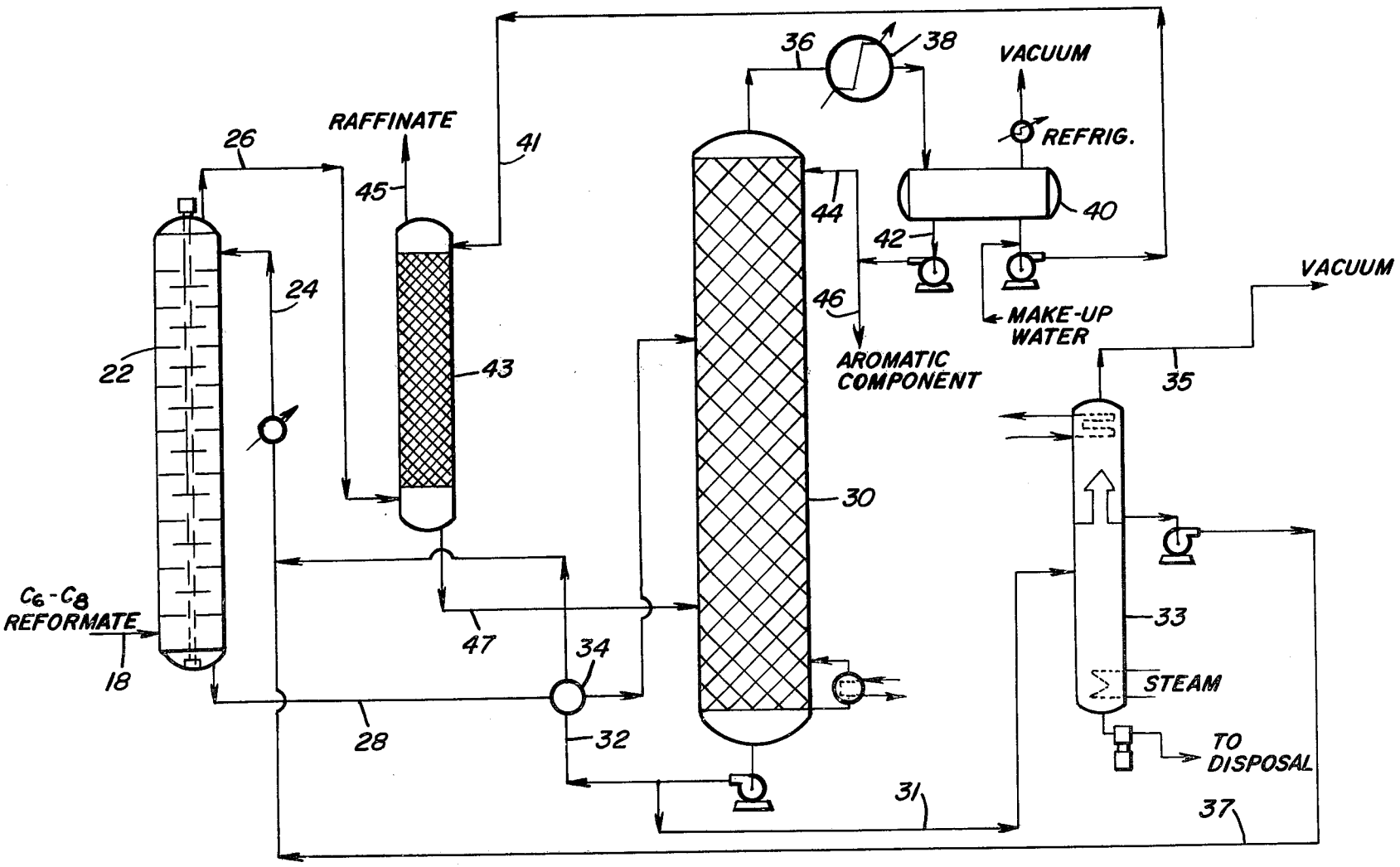

The operation of continuous solvent extraction unit 20 is further explained by reference to FIG. 2 wherein $C_6$- $C_8$ reformate is fed through line 18 to extraction unit 22, shown as a rotating disc type contactor column. It is passed upwardly in countercurrent contact with lean solvent introduced at the top of column 22 through line 24. A paraffin-rich raffinate phase is removed at the top of the column through line 26 and aromatic-rich solvent phase is removed from the bottom of the contactor through line 28, where it is pre-heated and introduced to aromatic recovery tower 30 for stripping the solvent and recovering the aromatic-rich extract.

The solvent is recovered from the bottom of tower 30 through line 32. At least part of the hot recovered solvent is passed through heat exchanger 34 to pre-heat the solvent phase in line 28. Thereafter, it is recycled to extraction column 22 through line 24. Aromatic-rich moist vapor leaving the top of tower 30 through line 36 is cooled in condenser 38 and collected to drum 40. A part of the aromatic-rich product stream 42 may be refluxed to the solvent stripper unit 30 through line 44, and the impure aromatic component is fed through line 46 to hydrodealkylation unit 50. Water from drum 40 is passed through line 41 to tower 43 where it is contacted with paraffinic raffinate from the extraction tower 22 to remove any solvent from the raffinate. The water-washed raffinate, consisting essentially of $C_6$- $C_8$ paraffins containing less than 10% aromatics, is then recycled through line 45 to reformer unit 10 and the aqueous stream containing wash water and solvent is taken through line 47 to tower 30.

A portion of the recovered solvent from tower 30 may be passed through line 21 to solvent regeneration unit 33 where a portion of the solvent may be discarded from the bottom of the regeneration unit 33. The solvent is returned through line 37 to the extraction tower 22 for recycle.

A material balance for a typical simplified solvent extraction system as set forth in Table 1, wherein steady state flow rates are given in kilograms per hour, temperature in degrees Celsius and pressure in atmospheres absolute.

TABLE I

| STREAM NO. | 18 | 26 | 24 | 28 | 41 | 47 | 45 | 46 | 31 | 37 |
|---|---|---|---|---|---|---|---|---|---|---|
| Benzene, KG/Hr. | 2830 | 70 | — | 2760 | — | — | 70 | 2760 | — | — |
| Toluene | 8500 | 540 | — | 7960 | — | — | 540 | 7960 | — | — |
| $C_8$ Aromatics | 2830 | 420 | — | 2410 | — | — | 420 | 2410 | — | — |
| $C_6$–$C_8$ Saturates, KG/hr. | 11140 | 9250 | — | 1890 | — | — | 9250 | 1890 | — | — |
| Sulfolane | — | 200 | 66500 | 66300 | — | 200 | — | — | 332 | 332 |
| Water | — | 2 | 420 | 418 | 2000 | 2002 | — | — | 2 | 2 |
| | 25300 | 10482 | 66920 | 81738 | 2000 | 2202 | 10280 | 15020 | 334 | 334 |
| Temp.° C. | 49 | 49 | 49 | 49 | 41 | 44 | 44 | 41 | 193 | 41 |
| Pressure,ATM,abs. | 6 | 6 | 6 | 6 | 4 | 4 | 4 | 0.9 | 0.1 | 4 |

Equipment suitable for extracting the aromatic hydrocarbons from the reformate with a selective sulfolane solvent can include a rotating disc contactor, tray-type or packed column. The preferred continuous countercurrent solvent extraction tower consists essentially of a vertical extraction column having means for introducing a lean solvent phase at the upper end of the tower, means for removing aromatic-rich solvent at the bottom of the tower, means for feeding the reformate to the tower, and means for removing a paraffin-rich raffinate phase from the tower, and means for effecting intimate contact between the solvent and paraffin phases. This step may be carried out under essentially steady state flow conditions.

After recovering the selective solvent from the extract phase, an aromatic component is obtained which comprises at least 80 weight percent $C_6$ - $C_8$ aromatic hydrocarbons and about 3 to 18 weight percent paraffinic hydrocarbons. Minor amounts of cycloaliphatic impurities may be present, depending upon the feed to the reformer, reaction conditions, reforming catalysts, etc. This impure extract is suitable for hydrodealkylating the aromatic component and converting paraffinic impurities to easily separable gases.

In order to enhance solvent selectivity, it is advantageous that relatively low temperatures should be employed for the extraction step. Where sulfolane is the major component of the solvent, temperatures of 25° C. to 150° C. should be maintained, with optimum results being achieved when not exceeding 65° C.

The system is intended to extract aromatic components from reformate containing a total of about 20 to 80 weight percent aromatics, which may include benzenoid compounds substituted with one or more methyl, ethyl or other lower alkyl groups.

Recovery of lean solvent and the aromatic-rich extract in the present process is an energy-saving step. Since a light paraffin backwash stream is not needed to obtain the ultimate benzene purity after dealkylation, a separate still for light paraffin recycle is not needed. Omission of this portion of the prior art system results in savings of up to half the energy required for the overall extraction-recovery sub-system. An extract/solvent stream may be separated by distillation, which is conducted at a preferred temperature at least 30° C. higher than the extraction step.

The selective solvents useful herein are known in the art. Pure hydrophilic organic compounds and binary mixtures are commonly used. While the use of sulfolane (preferably with ½ to 12% water) has been given as an example, various solvents comprising a major amount of at least one selected substituted sulfolanes, alkanol amines, pyrrolidones and glycols may be employed to advantage. N-methyl pyrrolidone, diethylene glycol, and monoethanol amine with varying amounts of water have all been used successfully as selective extraction solvents. Other solvents are disclosed in U.S. Pat. Nos. 2,921,015 and 2,938,858, incorporated herein by reference.

While the present invention has been described by certain examples, there is no intent to limit the inventive concept except as set forth in the following claims.

What is claimed is:

1. A process for converting a naphtha feedstock to a pure benzene comprising:

(a) reforming the naphtha;

(b) removing a major fraction of $C_4$ - $C_5$ and heavy reformate components to obtain a reformate containing a major portion of $C_6$ - $C_8$ aromatic hydrocarbons and a minor paraffinic portion;

(c) extracting the aromatic hydrocarbons from the reformate countercurrently with a selective hydrophilic solvent having high solubility aromatic hydrocarbons and low solubility for paraffinic hydrocarbons to obtain an extract stream rich in $C_6$ - $C_8$ aromatic hydrocarbons and a raffinate stream rich in paraffinic hydrocarbons;

(d) recovering the selective solvent from the extract stream to obtain an aromatic component comprising about 80 to 96 wt. % $C_6$ - $C_8$ aromatic hydrocarbons and about 3 to 18 wt. % paraffinic hydrocarbons;

(e) hydrodealkylating the aromatic component; and (f) recovering substantially pure benzene.

2. The process of claim 1 wherein the raffinate stream is recycled to the reforming step (a) and no stream rich in paraffin is recycled to extraction step (c).

3. The process of claim 1 wherein the selective solvent comprises a major amount of at least one hydrophilic organic solvent selected from sulfolanes, alkanol amines, pyrrolidones, and glycols.

4. The process of claim 3 where the selective solvent consists essentially of sulfolane and about ½ to 12 wt. % water.

5. The process of claim 4 wherein solvent recovery step (d) is conducted by distillation at a temperature at least 30° C. higher than extraction step (c).

6. The process of claim 5 wherein extraction step (c) is conducted at about 25° C. to 150° C.

7. The process of claim 6 wherein the temperature of extraction does not exceed about 65° C.

8. The process of claim 1 wherein the reformate feed to solvent extraction step (c) contains about 20 to 80 weight percent aromatic hydrocarbons.

9. A process for converting a naphtha feedstock to a pure benzene comprising:

reforming the naphtha; removing a major fraction of $C_4$ - $C_5$ and heavy reformate components to obtain a reformate containing a major portion of $C_6$ - $C_8$ aromatic hydrocarbons and a minor paraffinic portion;

extracting the aromatic hydrocarbons from the reformate with a selective sulfolane solvent having a high solubility aromatic hydrocarbons and low solubility for paraffinic hydrocarbons in a continuous countercurrent solvent extraction tower consisting essentially of an extraction column having:

(a) means for introducing a lean solvent phase at an upper end of the tower, (b) means for removing aromatic-rich solvent at the bottom of the tower, (c) means for feeding the reformate to the tower, and (d) means for removing a paraffin-rich raffinate phase from the tower, and means for effecting countercurrent contact between the solvent and paraffin phases; to obtain an extract phase rich in $C_6$ - $C_8$ aromatic hydrocarbons and a raffinate phase rich in paraffinic hydrocarbons;

recovering the selective solvent from the extract phase to obtain an aromatic component comprising at least 80 weight percent $C_6$ - $C_8$ aromatic hydrocarbons, and about 3 to 18 weight percent paraffinic hydrocarbons;

hydrodealkylating the aromatic component; and recovering substantially pure benzene.

10. The process of claim 1 wherein the paraffinic raffinate is contacted with water to remove any residual solvent and the raffinate is recycled to the naphtha reforming step.

11. A continuous process for converting a naphtha feedstock to benzene comprising:

catalytically reforming the naphtha;

removing by-product gas, $C_4$ - $C_5$ components and heavy reformate to obtain a $C_6$ - $C_8$ reformate rich in aromatic hydrocarbons;

extracting aromatic hydrocarbons from the $C_6$ - $C_8$ reformate with a selective solvent having high solubility for aromatic hydrocarbons and low solubility for aliphatic hydrocarbons to obtain an extract phase rich in $C_6$ - $C_8$ aromatic hydrocarbons and a raffinate phase rich in aliphatic hydrocarbons;

separating the extract phase from the raffinate phase;

recovering the raffinate phase to recycle to the catalytic reforming step;

recovering the selective solvent from the extract phase to obtain an aromatic stream containing about 3 to 18 weight percent aliphatic hydrocarbon impurity;

hydrodealkylating the impure aromatic stream and the heavy reformate;

recovering substantially pure benzene and hydrodealkylation off-gas;

combining the hydrodealkylation off-gas with at least a portion of the by-product gas from reforming and separating the combined gases in a purification unit to recover a fuel gas and purified hydrogen; and passing the purified hydrogen to the hydrodealkylation step.

* * * * *